US007192512B2

(12) United States Patent
Fischer et al.

(10) Patent No.: US 7,192,512 B2
(45) Date of Patent: Mar. 20, 2007

(54) METHOD FOR PRODUCING ORTHOCARBONIC ACID TRIALKYL ESTERS

(75) Inventors: Andreas Fischer, Ludwigshafen (DE); Hermann Pütter, Neustadt (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 87 days.

(21) Appl. No.: 10/363,317

(22) PCT Filed: Sep. 5, 2001

(86) PCT No.: PCT/EP01/10216

§ 371 (c)(1),
(2), (4) Date: Mar. 3, 2003

(87) PCT Pub. No.: WO02/20446

PCT Pub. Date: Mar. 14, 2002

(65) Prior Publication Data

US 2003/0183534 A1 Oct. 2, 2003

(30) Foreign Application Priority Data

Sep. 6, 2000 (DE) ..... 100 43 789

(51) Int. Cl.
*C25B 3/00* (2006.01)
*C25B 3/02* (2006.01)

(52) U.S. Cl. ..... 205/455; 205/456; 205/413; 205/447

(58) Field of Classification Search ..... 205/447, 205/455, 456, 413
See application file for complete search history.

(56) References Cited

FOREIGN PATENT DOCUMENTS

| | | |
|---|---|---|
| EP | 0 179 289 | 4/1986 |
| EP | 0 212 509 | 3/1987 |
| EP | 0 393 668 | 10/1990 |

OTHER PUBLICATIONS

Ginzel et al., "Indirect Electrochemical Alpha-Methoxylation of Aliphatic Ethers and Acetal. Reactivity and Regioselectivity of the Anodic Oxidation Using Tris(2,4-dibromophenyl)amine as Redox Catalyst", Tetrahedron (no month, 1987), vol. 43, No. 24, pp. 5797-5805.*

* cited by examiner

*Primary Examiner*—Edna Wong
(74) *Attorney, Agent, or Firm*—Oblon, Spivak, McClelland, Maier & Neustadt, P.C.

(57) ABSTRACT

A process is provided for the preparation of trialkyl orthocarboxylates by the electrochemical oxidation of alpha, beta-diketones or alpha, beta-hydroxyketones, the keto group being present in the form of a ketal group derived from $C_1$- to $C_4$-alkylalcohols and the hydroxyl group optionally being present in the form of an ether group derived from $C_1$- to $C_4$-alkylalcohols (ketals K), in the presence of $C_1$- to $C_4$-alcohols (alcohols A), the molar ratio of the ketals K to the alcohols A in the electrolyte being 0.2:1 to 10:1.

14 Claims, No Drawings

METHOD FOR PRODUCING ORTHOCARBONIC ACID TRIALKYL ESTERS

CROSS-REFERENCE TO RELATED APPLICATIONS

This application is a 371 National Stage Application of PCT/EP01/10216 filed on Sep. 5, 2001.

BACKGROUND OF THE INVENTION

The invention relates to a process for the preparation of trialkyl orthocarboxylates (orthoesters O) by the electrochemical oxidation of alpha, beta-diketones or alpha, beta-hydroxyketones, the keto group being present in the form of a ketal group derived from $C_1$- to $C_4$-alkylalcohols and the hydroxyl group optionally being present in the form of an ether group derived from $C_1$- to $C_4$-alkylalcohols (ketals K) ; in the presence of $C_1$- to $C_4$-alcohols (alcohols A), the molar ratio of the sum of the orthoesters (O) and the ketals (K) to the alcohols (A) in the electrolyte being 0.2:1 to 5:1.

DESCRIPTION OF THE BACKGROUND

DE-A-3606472, for example, discloses non-electrochemical processes for the preparation of trialkyl orthocarboxylates such as trimethyl orthoformate (TMOF), chloroform being reacted with sodium methylate.

J. Org. Chem., 20 (1955) 1573, further discloses the preparation of TMOF from hydrocyanic acid and methanol.

J. Amer. Chem. Soc., (1975) 2546, J. Org. Chem., 61 (1996) 3256, and Electrochim. Acta, 42 (1997) 1933, disclose electrochemical processes by which C—C single bonds between C atoms each carrying an alkoxy group can be oxidatively cleaved, but the specific formation of orthoester groups is not described.

Russ. Chem. Bull., 48 (1999) 2093, discloses that vicinal diketones present in the form of their acetals are decomposed to the corresponding dimethyl dicarboxylates by anodic oxidation using high charge quantities and in the presence of a large excess of methanol (cf. p. 2097, column 1, paragraph 5).

Canadian Journal of Chemistry, 50 (1972) 3424, describes the anodic oxidation of benzil tetramethyldiketal to trimethyl orthobenzoate in a more than 100-fold excess of methanol. According to the authors, however, the product yield is only 62% and the current efficiency 5%.

Journ. Am. Chem. Soc., (1963) 2525, describes the electrochemical oxidation of orthoquinone tetramethylketal to the corresponding orthoester in a basic methanol solution. The reaction was carried out in a basic methanol solution with a substrate concentration of 10%. The product yield was 77% with a current efficiency of 6% (16 F/mol). It has not been possible hitherto to prepare purely aliphatic orthoesters electrochemically.

SUMMARY OF THE INVENTION

It is an object of the present invention to provide an electrochemical process for the preparation of trialkyl orthocarboxylates in an economic manner and especially with a high current efficiency, high product yields and a high selectivity.

We have found that this object is achieved by the process described at the outset.

The process according to the invention is particularly suitable for the preparation of orthoesters I of general formula I:

I

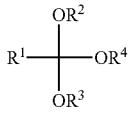

in which the radicals are defined as follows:

$R^1$ is hydrogen, $C_1$- to $C_{20}$-alkyl, $C_2$- to $C_{20}$-alkenyl, $C_2$- to $C_{20}$-alkynyl, $C_3$- to $C_{12}$-cycloalkyl, $C_4$- to $C_{20}$-cycloalkylalkyl, $C_4$- to $C_{10}$-aryl or optionally monosubstituted to trisubstituted by $C_1$- to $C_8$-alkoxy or $C_1$- to $C_8$-alkoxycarbonyl;

$R^2$, $R^3$ are $C_1$- to $C_{20}$-alkyl, $C_3$- to $C_{12}$-cycloalkyl or $C_4$- to $C_{20}$-cycloalkylalkyl, or $R^2$ and $R^3$ together form $C_2$- to $C_{10}$-alkylene; and $R^4$ is $C_1$- to $C_4$-alkyl.

DETAILED DESCRIPTION OF THE PREFERRED EMBODIMENTS

Said orthoesters are prepared starting from ketals II of general formula II:

II

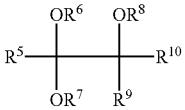

in which the radicals are defined as follows:

$R^5$ and $R^{10}$ are as defined for $R^1$;

$R^6$ and $R^7$ are as defined for $R^2$;

$R^8$ is hydrogen if $R^9$ is as defined for $R^1$, or is as defined for $R^2$; and $R^9$ is as defined for $R^1$ or is —O—$R^2$.

It is also possible to obtain the orthoesters I in the form of a mixture with ketals IV of general formula IV:

IV

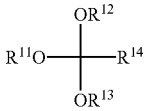

in which the radicals are defined as follows:

$R^{11}$ is as defined for $R^4$;

$R^{12}$ is as defined for $R^2$; and $R^{13}$ and $R^{14}$ are as defined for $R^1$.

Said orthoesters are prepared starting from ketals II in which $R^9$ is exclusively as defined for $R^1$.

The process according to the invention can be used to particular advantage to prepare orthoesters of general formula Ia (orthoesters Ia):

Ia

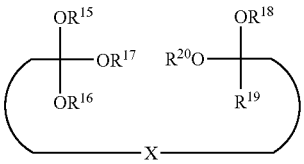

in which the radicals are defined as follows:

$R^{15}$ and $R^{16}$ are as defined for $R^2$;

$R^{18}$ is as defined for $R^2$;

$R^{17}$ and $R^{20}$ are as defined for $R^4$;

$R^{19}$ is as defined for $R^2$; and

X is $C_2$- to $C_{12}$-alkylene (orthoesters Ia).

Said orthoesters are prepared starting from ketals of general formula IIa:

IIa

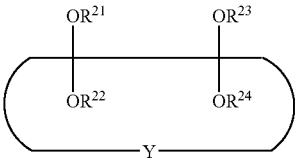

in which the radicals are defined as follows:

$R^{21}$ and $R^{22}$ are as defined for $R^2$;

$R^{23}$ is as defined for $R^8$;

$R^{24}$ is as defined for $R^9$; and

Y is as defined for X (ketals IIa).

The ketals used according to the invention are obtainable by generally known preparative processes. In the case of ketals with functional groups, these are most easily prepared by starting from a precursor which carries a C—C double bond in place of the desired functional group, and then functionalizing said double bond by standard methods (cf. Synthesis, (1981) 501–522).

The process according to the invention can also be used to particular advantage to prepare orthoesters of formula Ib:

Ib

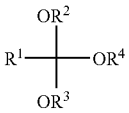

wherein $R^1$ is hydrogen, $C_1$–$C_{20}$-alkyl, $C_3$–$C_{12}$-cycloalkyl or $C_4$–$C_{20}$-cycloalkylalkyl;

$R^2$ and $R^3$ are each $C_1$- to $C_{20}$-alkyl, $C_3$- to $C_{12}$-cycloalkyl or $C_4$- to $C_{20}$-cycloalkylalkyl, or $R^2$ and $R^3$ together form $C_2$- to $C_{10}$-alkylene; and $R^4$ is $C^1$- to $C^4$alkyl (orthoesters Ib), starting from ketals II in which the radicals are defined as follows:

$R^5$ and $R^{10}$ are as defined for group $R^1$ in orthoesters Ib; and $R^6$ to $R^9$ are as defined for $R^2$ or $R^3$ in orthoesters Ib (ketals IIb).

Within the group of orthoesters Ib, the process according to the invention can be used especially to prepare orthoesters of formula Ic:

Ic

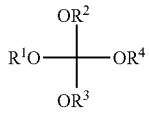

wherein $R^1$ is hydrogen or $C_1$- to $C_6$-alkyl; and $R^2$, $R^3$ and $R^4$ are methyl or ethyl (orthoesters Ic), starting from ketals II in which the radicals are defined as follows:

$R^5$ and $R^{10}$ are as defined for $R^1$ in orthoesters Ic; and $R^6$ to $R^9$ are as defined for $R^2$ or $R^3$ in orthoesters Ic (ketals IIc).

In the ketals IIb and IIc the radicals $R^5$ and $R^{10}$ preferably have the same definition.

The process according to the invention can be used to very particular advantage to prepare methyl orthoformate (TMOF) or ethyl orthoformate or methyl or ethyl orthoacetate (orthoesters Id), the corresponding starting compounds being 1,1,2,2-tetramethoxyethane (TME) or 1,1,2,2-tetraethoxyethane (ketals IId).

In the electrolyte the molar ratio of the sum of the orthoesters (O) and the ketals K to the alcohols A is 0.2:1 to 5:1, preferably 0.2:1–2:1 and particularly preferably 0.3:1 to 1:1.

The conducting salts present in the electrolysis solution are generally alkali metal, tetra($C_1$- to $C_6$-alkyl)ammonium or tri($C_1$- to $C_6$-alkyl)benzylammonium salts. Suitable counterions are sulfate, hydrogensulfate, alkylsulfates, arylsulfates, halides, phosphates, carbonates, alkylphosphates, alkylcarbonates, nitrate, alcoholates, tetrafluoroborate or perchlorate.

The acids derived from the abovementioned anions are also suitable as conducting salts.

Methyltributylammonium methylsulfates (MTBS), methyltriethylammonium methylsulfate or methyltripropylmethylammonium methylsulfates are preferred.

Conventional cosolvents are optionally added to the electrolysis solution. These are the inert solvents with a high oxidation protential which are generally conventional in organic chemistry. Dimethyl carbonate or propylene carbonate may be mentioned as examples.

The process according to the invention can be carried out in any of the conventional types of electrolysis cell. It is preferably carried out continuously with non-compartmentalized flow-through cells.

When the process is carried out continuously, the feed rate of the educts is generally chosen so that the weight ratio of the ketals K used to the orthoesters I formed in the electrolyte is 10:1 to 0.05:1.

The current densities used to carry out the process are generally 1 to 1000 and preferably 10 to 100 mA/cm$^2$. The temperatures are conventionally −20 to 60° C. and preferably 0 to 60° C. The working pressure is generally atmospheric pressure. Higher pressures are preferably applied when the process is to be carried out at higher temperatures, in order to prevent the starting compounds or cosolvents from boiling.

Examples of suitable anode materials are noble metals such as platinum, or metal oxides such as ruthenium or chromium oxide or mixed oxides of the type $RuO_xTiO_x$. Graphite or carbon electrodes are preferred.

Examples of suitable cathode materials are iron, steel, stainless steel, nickel, noble metals such as platinum, and graphite or carbon materials. Preferred systems have graphite as the anode and cathode or graphite as the anode and nickel, stainless steel or steel as the cathode.

When the reaction has ended, the electrolysis solution is worked up by general methods of separation. This is generally done by first distilling the electrolysis solution to give the individual compounds separately in the form of different fractions. These can be purified further, for example by crystallization, distillation or chromatography.

Experimental Section

EXAMPLE 1

A non-compartmentalized cell with graphite electrodes in a bipolar arrangement was used. The total electrode surface area was 0.145 $m^2$ (anode and cathode). The electrolyte used was a solution consisting of 2 mol of methanol to 1 mol of TME and containing 2% by weight of MTBS as the conducting salt. Electrolysis was carried out at 300 $A/m^2$ and a charge quantity of 2 F, based on TME, was passed through the cell. The electrolysis temperature was 20° C. When the electrolysis had ended, the products were determined quantitatively by gas chromatography and qualitatively by GC coupled with MS. TMOF was formed with a selectivity of 77% for a TME conversion of 69%. The principal byproducts were methyl formate and methylal.

EXAMPLE 2

240.3 g of 1,1,2-trimethoxyethane, 320 g of methanol and 5.8 g of ammonium tetrafluoroborate were placed in an electrolysis cell with an electrode surface area of 316.4 $cm^2$, but otherwise as described in Example 1, and subjected to electrolysis. The electrolysis conditions were as described in Example 1. The electrolysis products contained 9.5 GC area % of formaldehyde dimethylacetal and 5.9 GC area % of trimethyl orthoformate.

EXAMPLE 3

89 g of 2,2,3,3-tetramethoxybutene (80% pure, prepared from diacetyl and trimethyl orthoformate), 64 g of methanol and 1.7 g of ammonium tetrafluoroborate were reacted in an electrolysis cell with an electrode surface area of 298.8 $cm^2$, but otherwise as described in Example 1. The electrolysis conditions were as described in Example 1. The electrolysis products contained 1.7 GC area % of trimethyl orthoacetate for a current quantity of 2 Faraday and 18 GC area % for a current quantity of 8 F.

EXAMPLE 4

In an electrolysis operated continuously at a current density of 310 $A/m^2$ on graphite electrodes with a methanol-to-1,1,2,2-tetramethoxyethane feed of 1.5 mol to 1 mol and an MTBS content of 8% by weight, the electrolysis products contained TMOF with a selectivity of 95% and a current efficiency of 78% for a TME conversion of 41%.

We claim:

1. A process for the preparation of a trialkyl orthocarboxylate (orthoester O), comprising:

electrochemically oxidizing an alpha,beta-diketone or an alpha, beta-hydroxyketone, wherein the keto groups of the alpha, beta-diketone compound or the keto group of the alpha, beta-hydroxyketone compound are present in the form of ketal groups derived from $C_1$- to $C_4$-alkylalcohols and the hydroxyl group of the alpha-beta-hydroxyketone optionally being present in the form of an ether group derived from $C_1$- to $C_4$-alkylalcohols (ketals K), in the presence of a $C_1$- to $C_4$-alcohol (alcohols A) medium that contains an medium electrolyte, the molar ratio of the sum of the orthoester O and the ketals K to the alcohols A in the medium ranging from 0.2:1 to 5:1.

2. The process as claimed in claim 1, wherein the electrolyte is a conducting salt of a tetra($C_1$- to $C_6$-alkyl) ammonium or a tri($C_1$- to $C_6$alkyl)benzylammonium cation with sulfate, hydrogensulfate, alkylsulfates, arylsulfates, halides, phosphates, carbonates, alkylphosphates, alkylcarbonates, nitrate, alcoholates, tetrafluoroborate or perchlorate as a counterion.

3. The process as claimed in claim 1, wherein the electrolyte is a conducting salt which is methyltributylammonium ethylsulfate, methyltripropylammonium methylsulfate, methyltriethylammonium methylsulfate or tetramethylammonium methylsulfate.

4. The process as claimed in claim 1, which is conducted in a non-compartmentalized electrolysis cell.

5. The process as claimed in claim 1, wherein the charge quantity per mol of oxidized alpha, beta-diketone or alpha, beta-hydroxyketone is 2 to 4 F.

6. The process as claimed in claim 1, wherein the electrochemical oxidation is conducted at a current density of 1 to 1000 $mA/cm^2$.

7. The process as claimed in claim 1, wherein the electrochemical oxidation is conducted at a current density of 10 to 100 $mA/cm^2$.

8. The process as claimed in claim 1, wherein the electrochemical oxidation is conducted at a temperature ranging from −20 to 60° C.

9. The process as claimed in claim 8, wherein the electrochemical oxidation is conducted at a temperature ranging from 0 to 60° C.

10. A process for the preparation of a trialkyl orthocarboxylate, comprising:

electrochemically oxidizing a ketal II of formula II:

II

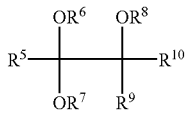

wherein the radicals are defined as follows:

$R^5$ and $R^{10}$ are as defined for $R^1$ below;

$R^6$ and $R^7$ are as defined for $R^2$ below;

$R^8$ is hydrogen if $R^9$ is as defined for $R^1$, or is as defined for $R^2$; and $R^9$ is as defined for $R^1$ or is —O—$R^2$, to an orthoester I that is a compound of formula I:

I

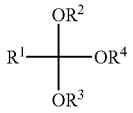

wherein the radicals are defined as follows:

$R^1$ is hydrogen, $C_1$- to $C_{20}$-alkyl, $C_2$- to $C_{20}$-alkenyl, $C_2$- to $C_{20}$-alkynyl, $C_3$- to $C_{12}$-cycloalkyl, $C_4$- to $C_{20}$-cycloalkylalkyl, $C_4$- to $C_{10}$-aryl or optionally monosubstituted to trisubstituted by $C_1$- to $C_8$-alkoxy or $C_1$- to $C_8$-alkoxycarbonyl;

$R^2$ and $R^3$ are each $C_1$- to $C_{20}$-alkyl, $C_3$- to $C_{12}$-cycloalkyl or $C_4$- to $C_{20}$-cycloalkylalkyl, or $R^2$ and $R^3$ together form a $C_2$- to $C_{10}$-alkylene; and $R^4$ is $C_1$- to $C_4$-alkyl.

11. The process as claimed in claim 10, wherein the orthoester I is an orthoester compound of the formula Ic:

Ic

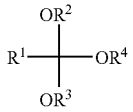

wherein:

$R^1$ is hydrogen or $C_1$ to $C_6$-alkyl and $R^2$, $R^3$ and $R^4$ are methyl or ethyl, and the ketal II has formula II:

II

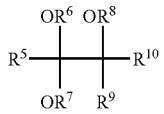

wherein the radicals are defined as follows:

$R^5$ and $R^{10}$ have the meaning of $R^1$ and $R^6$ to $R^9$ have the meaning of $R^2$ or $R^1$.

12. The process as claimed in claim 11, wherein the orthoester I is methyl or ethyl orthoformate or methyl or ethyl orthoacetate, and the ketal II is 1,1,2,2-tetramethoxyethane or 1,1,2,2-tetraethoxyethane, or 1,1,2,2-tetramethoxypropane or 1,1,2,2-tetraethoxypropane, or 2,2,3,3tetramethoxybutane or 2,2,3,3tetraethoxybutane.

13. A process for the preparation of a trialkyl orthocarboxylate, comprising:

electrochemically oxidizing a ketal II of formula II:

II

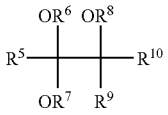

wherein the radicals are defined as follows:

$R^5$ and $R^{10}$ are each hydrogen, $C_1$- to $C_{20}$-alkyl, $C_2$- to $C_{20}$-alkenyl, $C_2$- to $C_{20}$-alkynyl, $C_3$- to $C_{12}$-cycloalkyl, $C_4$- to $C_{20}$-cycloalkylalkyl, $C_4$- to $C_{10}$-aryl or optionally monosubstituted to trisubstituted by $C_1$- to $C_8$-alkoxy or $C_1$- to $C_8$-alkoxycarbonyl;

$R^6$ and $R^7$ are each $C_1$- to $C_{20}$-alkyl, $C_3$- to $C_{12}$-cycloalkyl or $C_4$- to $C_{20}$-cycloalkylalkyl, or $R^6$ and $R^7$ together form a $C_2$- to $C_{10}$-alkylene;

$R^8$ is hydrogen if $R^9$ is as defined for $R^5$ and $R^{10}$, or is as defined for $R^6$ and $R^7$, and $R^9$ is hydrogen, $C_1$- to $C_{20}$-alkyl, $C_2$- to $C_{20}$-alkenyl, $C_2$- to $C_{20}$-alkynyl, $C_3$- to $C_{12}$-cycloalkyl, $C_4$- to $C_{20}$-cycloalkylalkyl, $C_4$- to $C_{10}$-aryl or optionally monosubstituted to trisubstituted by $C_1$- to $C_8$-alkoxy or $C_1$- to $C_8$-alkoxycarbonyl, to a mixture of an orthoester I of formula I:

I

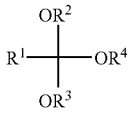

wherein the radicals are defined as follows:

$R^1$ is hydrogen, $C_1$- to $C_{20}$-alkyl, $C_2$- to $C_{20}$-alkenyl, $C_2$- to $C_{20}$-alkynyl, $C_3$- to $C_{12}$-cycloalkyl, $C_4$- to $C_{20}$-cycloalkylalkyl, $C_4$- to $C_{10}$-aryl or optionally monosubstituted to trisubstituted by $C_1$- to $C_8$-alkoxy or $C_1$- to $C_8$-alkoxycarbonyl;

$R^2$ and $R^3$ are each $C_1$- to $C_{20}$-alkyl, $C_3$- to $C_{12}$-cycloalkyl or $C_4$- to $C_{20}$-cycloalkylalkyl, or $R^2$ and $R^3$ together form a $C_2$- to $C_{10}$-alkylene; and $R_4$ is $C_1$- to $C_4$-alkyl and a ketal IV of formula IV

IV

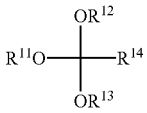

wherein the radicals are defined as follows:

$R^{11}$ is $C_1$- to $C_4$-alkyl;

$R^{12}$ is $C_1$- to $C_{20}$-alkyl, $C_3$- to $C_{12}$-cycloalkyl or $C_4$- to $C_{20}$-cycloalkylalkyl; and $R_{13}$ and $R^{14}$ is hydrogen, $C_1$- to $C_{20}$-alkyl, $C_2$- to $C_{20}$-alkenyl, $C_2$- to $C_{20}$-alkynyl, $C_3$- to $C_{12}$-cycloalkyl, $C_4$- to $C_{20}$-cycloalkylalkyl, $C_4$- to $C_{10}$-aryl or optionally monosubstituted to trisubstituted by $C_1$- to $C_8$-alkoxy or $C_1$- to $C_8$-alkoxycarbonyl.

14. A process for the preparation of a trialkyl orthocarboxylate, comprising:

electrochemically oxidizing a ketal II of formula IIa:

IIa

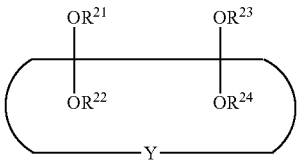

wherein the radicals are defined as follows:

$R^{12}$ and $R^{22}$ are each $C_1$- to $C_{20}$-alkyl, $C_3$- to $C_{12}$-cycloalkyl or $C_4$- to $C_{20}$-cycloalkylalkyl;

$R^{23}$ is hydrogen;

$R^{24}$ is hydrogen, $C_1$- to $C_{20}$-alkyl, $C_2$- to $C_{20}$-alkenyl, $C_2$- to $C_{20}$-alkynyl, $C_3$- to $C_{12}$-cycloalkyl, $C_4$- to $C_{20}$-cycloalkylalkyl, $C_4$- to $C_{10}$-aryl or optionally mono-substituted to trisubstituted by $C_1$- to $C_8$-alkoxy or $C_1$- to $C_8$-alkoxycarbonyl; and Y is as defined for X below, to an orthoester (Ia) that is a compound of formula la:

Ia

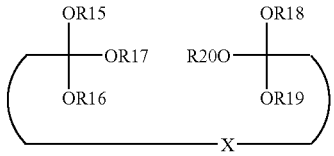

in which the radicals are defined as follows:

$R^{15}$ and $R^{16}$ are as defined for $R^{21}$ and $R^{22}$;

$R^{18}$ is as defined for $R^{21}$ and $R^{22}$;

$R^{17}$ and $R^{20}$ are $C_1$- to $C_4$-alkyl;

$R^{19}$ is as defined for $R^{21}$ and $R^{22}$; and

X is $C_2$- to $C_{12}$-alkylene.

* * * * *